US012298097B2

(12) United States Patent
Seigler

(10) Patent No.: US 12,298,097 B2
(45) **Date of Patent: *May 13, 2025**

(54) DRY FIRE PRACTICE TRAINING DEVICE WITH BOLT CARRIER GROUP FOR RIFLES

(71) Applicant: Sarah R. Seigler, Kamiah, ID (US)

(72) Inventor: Stanley Hahn Seigler, Kamiah, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/221,996

(22) Filed: Jul. 14, 2023

(65) Prior Publication Data

US 2023/0366650 A1 Nov. 16, 2023

Related U.S. Application Data

(63) Continuation of application No. 16/799,162, filed on Feb. 24, 2020, now Pat. No. 11,703,297.

(51) Int. Cl.

| | |
|---|---|
| ***F41A 33/00*** | (2006.01) |
| ***F41A 19/06*** | (2006.01) |
| ***F41G 3/26*** | (2006.01) |

(52) U.S. Cl.

CPC ..... *F41A 33/00* (2013.01); *F41A 19/06* (2013.01); *F41G 3/26* (2013.01)

(58) Field of Classification Search

CPC ..... F41A 33/00; F41A 19/06; F41G 3/26

See application file for complete search history.

(56) References Cited

U.S. PATENT DOCUMENTS

| | | | | |
|---|---|---|---|---|
| 1,432,254 | A * | 10/1922 | Paterson | F41A 33/02 362/112 |
| 4,657,511 | A | 4/1987 | Allard | |
| 4,725,235 | A | 2/1988 | Schroeder | |
| 4,737,106 | A | 4/1988 | Laciny | |
| 4,804,325 | A | 2/1989 | Willits | |
| 5,451,162 | A | 9/1995 | Parsons | |
| 5,993,215 | A | 11/1999 | Jensen | |
| 6,305,941 | B1 * | 10/2001 | Kotsiopoulos | F41G 3/2605 434/11 |
| 9,057,577 | B2 * | 6/2015 | Hannan | F41A 19/10 |
| 9,182,189 | B2 | 11/2015 | Seigler | |
| 11,313,638 | B2 * | 4/2022 | Dottle | F41A 33/02 |

(Continued)

FOREIGN PATENT DOCUMENTS

WO WO-2023183155 A2 * 9/2023

*Primary Examiner* — Alvin A Hunter
*Assistant Examiner* — Amir A Klayman
(74) *Attorney, Agent, or Firm* — Randall Danskin P.S.

(57) ABSTRACT

When a semiautomatic rifle is live fired, it is ready to be fired again. The shooter's hands remain in the firing position, and just to the trigger finger and trigger are employed. But with dry fire practice, the shooter must cycle the rifles bolt to reset the firing pin. The shooter must move one hand from the shooting position on the rifle, the rifles along bolt is pulled back to reset the firing pin, the rifle is repositioned, a new site picture is acquired, and then the next trigger press can be accomplished. This invention replaces the rifles bolt carrier group and provides realistic muscle memory training by duplicating the action of the trigger, the feel and the sound of the release of the firing pin, and the resetting of the trigger for additional trigger activations. The invention does not interact with the rifles firing pin.

9 Claims, 2 Drawing Sheets

(56) References Cited

U.S. PATENT DOCUMENTS

| | | | | |
|---|---|---|---|---|
| 2011/0281243 | A1* | 11/2011 | Uhr | F41A 33/00<br>434/11 |
| 2015/0300766 | A1* | 10/2015 | Sims | A63F 9/02<br>434/16 |
| 2023/0280134 | A1* | 9/2023 | Allgaier | F41A 9/61<br>434/21 |

* cited by examiner

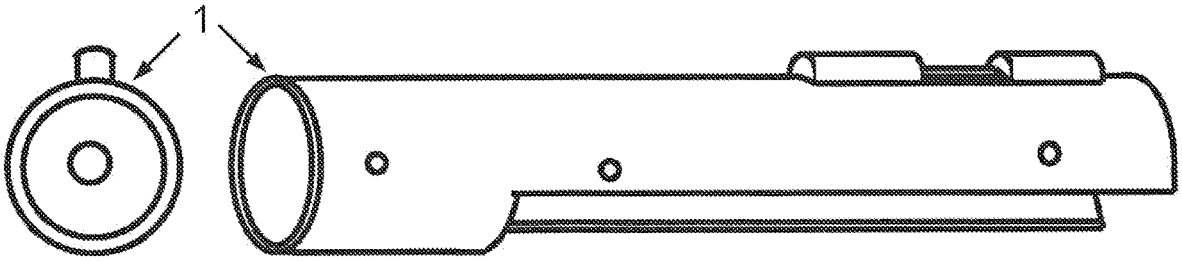
FIG. 1-A FIG. 1
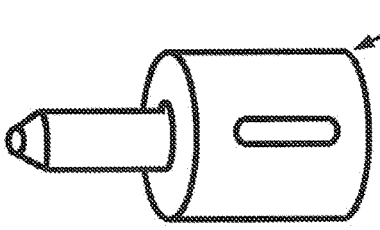
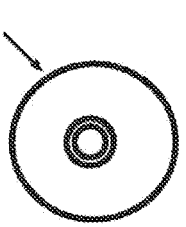
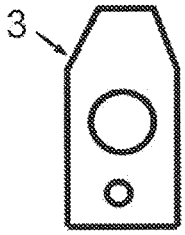
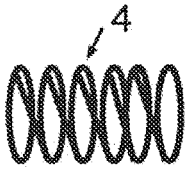
FIG. 2 FIG. 2-A FIG. 3 FIG. 4
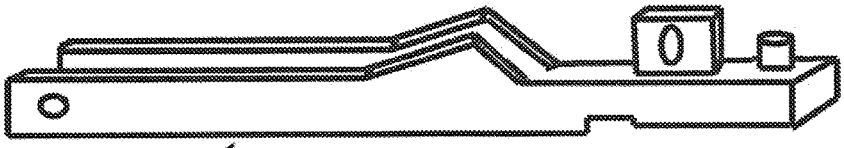
FIG. 5
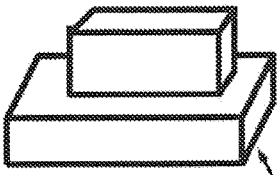
FIG. 6 6
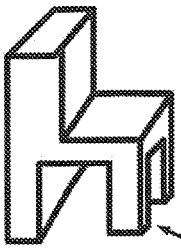
7
FIG.7
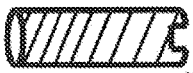
FIG. 8 8
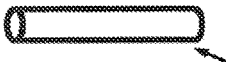
FIG. 9 9

DRY FIRE PRACTICE TRAINING DEVICE WITH BOLT CARRIER GROUP FOR RIFLES

CROSS REFERENCE TO RELATED APPLICATIONS

This US non-provisional patent application is a Continuation Application of previously filed US non-provisional application, Ser. No. 16/799,162 which was filed on Feb. 24, 2020, and having the same title, and for which the United States Patent and Trademark Office has issued a Notice of Allowance, but which has not yet issued.

The entire contents of the identified, and current pending, U.S. non-provisional application Ser. No. 16/799,162 is fully and entirely incorporated herein by this reference.

The inventorship of the above identified earlier filed and currently pending U.S. non-provisional patent application Ser. No. 16/799,162, is the same as the inventorship of the present Continuation non-provisional patent application.

BACKGROUND OF THE INVENTION

Live firing is the best way to practice firing a weapon. The practice process builds muscle memory and helps the shooter develop proper techniques of delivery and complete weapon control. There are several negatives of this type of practice. Using ammunition is an ongoing expense, and measures have to be taken to practice with safety. This could mean traveling to a firing range, providing safety equipment for the shooter and possibly others, and allotting special time in the schedule for the practice session.

Dry fire practice is a good substitute for live fire practice and could be considered better than live fire. Dry firing is another process of building muscle memory whereby a firearm is presented, aimed, and fired without using live ammunition. This enables the practice of firing a weapon to proceed smoothly and accurately without all the negatives of live fire practice. Because no live ammunition is used, there is no ongoing expense, there is no need to use safety equipment, a special shooting environment is not necessary, and practicing can be accomplished in much less time.

Dry firing also allows the shooter to practice in the actual environment where the weapon may need to be used for protection such as in a home. With complete safety, the actual shooting scenarios can be practiced in and around the home.

Practicing at the range can also be improved with a dry fire device. When live fire is practiced at the range, the novice shooter usually has to spend a significant amount of time and expend a lot of ammunition getting accustomed to the report and recoil of the weapon. Before live practice begins, some dry fire practicing cats be done. This gets the shooter accustomed to the trigger feel before having to deal with the recoil and the report of live firing.

A major negative factor occurs with the standard method of dry firing because when a semi-automatic weapon is live fired, it re-sets its firing pin and is ready to be fired again until the magazine is empty. The shooter's hands remain in the firing position, and just the trigger finger and the trigger are employed. With normal dry fire practice, after the first activation of the trigger releasing the firing pin, the shooter must remove a hand from the weapon and "ratchet" the bolt back in order to reset the firing pin. The shooter can then let the trigger return to its unfired position and then the weapon is ready for another trigger activation. This must be done each time a shot is simulated. Doing this teaches improper muscle memory because it is not at all what happens during actual live fire.

Another negative for standard dry fire practice is that there is concern as to the wear and tear on the constant releasing of a weapon's firing pin without it having the cushioning effect of the firing pin striking a round of ammunition.

Here are a few examples of weapon training patents:

US PATENT DOCUMENTS

- U.S. Pat. No. 5,993,215, Nov. 30, 1999, Jansen; Kotsiopoulos.
- U.S. Pat. No. 4,657,511, Apr. 14, 1987, Allard; Briard; Saunier.
- U.S. Pat. No. 4,725,235, Feb. 16, 1988 Schroeder; Osborne.
- U.S. Pat. No. 4,737,106, Apr. 12, 1988, Laciny
- U.S. Pat. No. 4,804,325, Feb. 14, 1989, Willits; Kleeman; Willits.
- U.S. Pat. No. 5,451,000, 162, Sep. 19, 1995, Parsons.
- 2011/0047847 A1 Mar. 2011, Hughes, et al, 42/1.01
- 2011/0306020 A1 Dec. 2011 Peterson, 434/18

Negative qualities of these devices or systems are that they are either user intensive and/or expensive to purchase or don't address the solution in the unique way that this design does.

There is also my previous patent that is specifically for handguns: U.S. Pat. No. 9,182,189 B2, Nov. 10, 2015 Seigler and another patent applied for by Seigler, this inventor, that is for rifles that solves this problem with a different design. This previously design replaces the standard trigger of a rifle. If the standard trigger has not already been replaced, it can be difficult to remove the holding pins and control the spring-loaded parts. Then, after the training session is over, these parts can be a challenge to replace. Additionally, the shooter may not want to replace his special trigger for the dry fire training session.

There is therefore a need for a dry fire training device that allows for precise muscle memory training that is designed for rifles, is simple to operate, prevents the firing pin of the weapon from being damaged, provides for safe on-site home training, and can allow the shooter to use the trigger that is already installed in his rifle.

BRIEF SUMMARY OF THE INVENTION

The invention that is to be described accomplishes the most important aspects of dry fire training specifically for rifles: no live ammunition is, used, providing safety and no ongoing expense, convenience of practicing in the home environment where the protective rifle would most likely be used, minimal disassembling and reassembling of the rifle's components, the realistic feel of the trigger during the firing process and the trigger reset, precise muscle memory training using only the trigger finger motion, does not negatively affect the rifles firing pin and hammer, and allows for the shooter to use his stock or custom trigger assembly. This invention also helps the novice shooter train with his rifle before having to deal with the recoil and the report of firing live ammunition. This invention is simple to use, provides realistic feel of the trigger operation, produces a sound, that simulates the release and reset of the rifle's firing pin, and does not require major alterations to the rifle. This invention is simple to install by removing the bolt carrier group that houses the rifle's firing pin, inserting the dry fire components that are the same basic shape of the bolt carrier group, inserting a member that immobilizes the rifle's hammer, and inserting another member that transfers the triggers movement to the bolt group assembly, then practice can begin. It requires minimal alteration to the rifle before and after practice. The new bolt carrier group houses a lever which has a detent reed mounted to it which snaps when the trigger is activated. This new device functions completely independent of the rifle's firing pin because the rifle's bolt containing the firing pin is removed and replaced with the new device assembly.

BRIEF DESCRIPTION OF THE SEVERAL VIEWS OF THE DRAWINGS

FIG. 1 illustrates an isometric view of a cylinder with various holes and cutaways.

FIG. 1-A illustrates an end view of the cylinder showing a recessed plug with the cylindrical depression for one end of one of the coil springs.

FIG. 2 illustrates an isometric view of a plunger.

FIG. 2-A illustrates an end view of the plunger showing a cylindrical depression for one end of one of the coil springs.

FIG. 3 illustrates a detent reed.

FIG. 4 illustrates an isometric view of a coil spring.

FIG. 5 illustrates an isometric view of a lever.

FIG. 6 illustrates an isometric view of a hammer block.

FIG. 7 illustrates an isometric view of a transfer block.

FIG. 8 illustrates an isometric view of a set screw.

FIG. 9 illustrates an isometric view of a hinge pin.

DETAILED DESCRIPTION OF THE INVENTION

Figure 10:
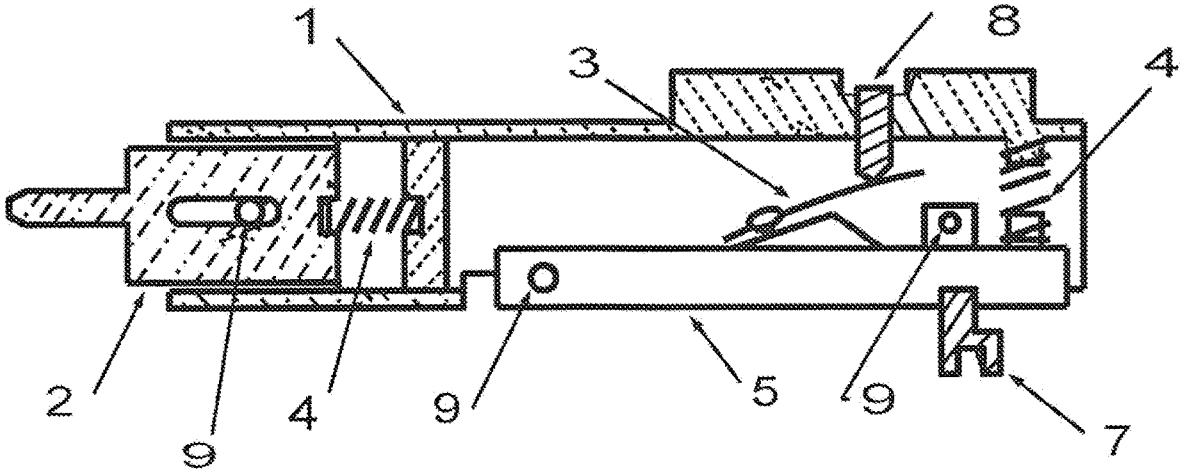
FIG. 10 illustrates a middle sectional view of an assembly of the bolt carrier group in its resting position.

FIG. 1 illustrates an isometric view of the cylinder 1 with a lower section removed, three pairs of holes to mount other parts, an upper raised section for maintaining the position of the cylinder 1 in the rifle's BCG compartment with a midsection for mounting the regulating screw 8 for adjusting the detent reed 3.

FIG. 1-A illustrates an end view of the cylinder 1 showing an internal plug with a cylindrical hole for one of the coil springs 4.

FIG. 2 illustrates an isometric view of the plunger 2 with a through slot for one of the fulcrum pins 9 to pass through for limiting the back and forth motion of the plunger 2, and a smaller projection from one end which locates into the chamber of the rifle thus positioning the cylinder 1 in the rifle's BCG's compartment.

FIG. 2-A illustrates the opposite end of the plunger 2 showing a cylindrical hole for locating one end of one of the coil springs 4.

FIG. 3 illustrates the detent reed 3 that supplies the snap sound and the tactile feel of the simulated release of the rifle's firing pin.

FIG. 4 illustrates one of the coil springs 4, one of which returns the lever 5 assembly to its resting position when the trigger is released, another for extending the plunger 2 for locating the device into the chamber of the rifle.

FIG. 5 illustrates the lever 5 with a pair of holes for the lever 5 to swing on the fulcrum pin 9, a pair of inclined ramps for mounting the detent reed 3, a rectangular projection that houses a slotted hole to guide the lever 5 in it's up and down motion and limited in its motion by the fulcrum pin 9 and a small raised cylindrical projection to retain one end of one of the coil springs 4.

FIG. 6 illustrates the hammer keeper 6 which prevents the hammer frog falling when the trigger is activated.

FIG. 7 illustrates the transfer block 7 which transfers the up-and-down movement of the trigger to the lower side of the lever 5.

FIG. 8 illustrates the set screw 8 that is used to regulate when in the movement of the lever 5 assembly that the detent reed 3 activates.

FIG. 9 illustrates the fulcrum pin 9 that pins the various parts together and/or allows for the controlled move met t of these parts.

FIG. 10 illustrates a sectional drawing of the assembled bolt carrier group consisting of the cylinder 1 to house the various parts comprised of the spring-loaded plunger 2 which locates the front end of the device in the rifle, the lever 5 which has the detent reed 3 secured to its top surface providing the tactile and audible simulation of the rifle's firing pin release and reset, a projection for one end of the coil springs 4 which returns the lever 5 to its resting position. The cylinder 1 also has the set screw 8 which allows for the adjusting of the position when the detent reed 3 snaps, simulating the release and reset of the rifle's firing pin.

Figure 11:
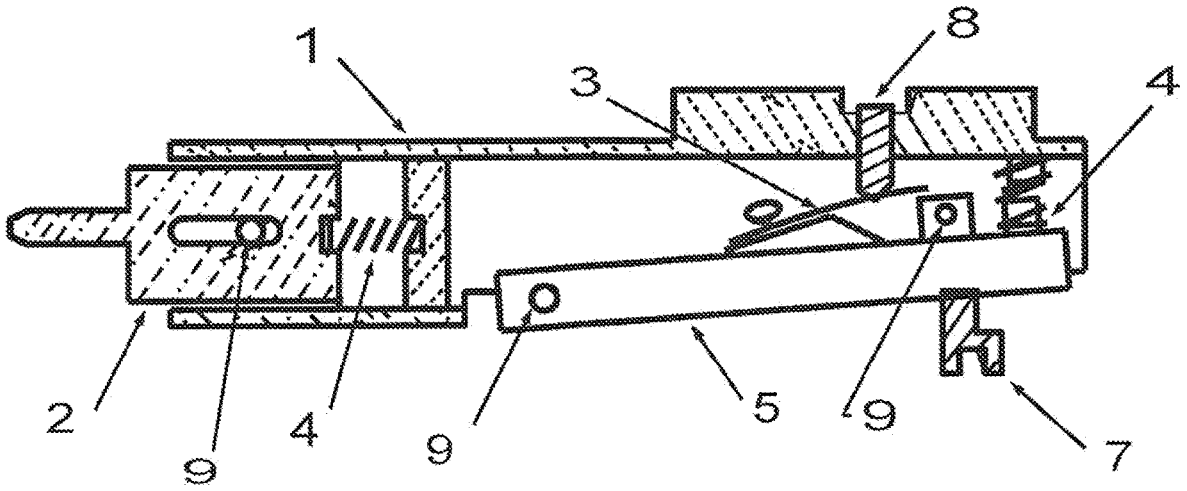
FIG. 11 illustrates a middle sectional view of an assembly of the bolt carrier group in its activated position.

FIG. 11 illustrates a sectional drawing of the assembled bolt carrier group in its activated position showing the lever 5 raised, the detent reed 3 bent and activated, and the transfer block 7 raised.

I claim:

1. A method for dry fire training with a semi-automatic rifle, comprising the steps:

providing a functional semi-automatic rifle that has a functional bolt carrier group in a bolt carrier group compartment, and wherein the functional bolt carrier group moves reciprocally within the bolt carrier group compartment between a first position, and a second position, in response to live ammunition being fired from the functional semi-automatic rifle, or in response to a user manually moving the functional bolt carrier group between the first position and the second position, and wherein the reciprocal movement of the bolt carrier group within the bolt carrier group compartment responsively resets a firing pin and a hammer of the functional semi-automatic rifle; and removing the functional bolt carrier group from the bolt carrier group compartment;

providing a cylinder that forms a generally cylindrical housing, that is elongate and which has a first end portion, a second end portion, an upper section, a lower section and a mid-section and which defines a generally cylindrical bore between the first end portion and the second end portion, and the lower section of the cylindrical housing defines a partial circumferential cut-out that begins at the second end portion and extends toward the first end portion but does not communicate with the first end portion, and the upper section of the generally cylindrical housing carries a protuberance proximate the second end portion and opposite the partial circumferential cut-out for alignment of the second end portion of the cylindrical housing in the bolt carrier group compartment;

providing a plunger, and installing the plunger in the cylindrical bore of the generally cylindrical housing so that the plunger is axially movably carried in the cylindrical bore of the cylindrical housing at the first end portion thereof, the plunger having a protuberance that extends axially outwardly from the plunger, and opposite the cylindrical bore, and the plunger further defines a diametrically extending through slot for a fulcrum pin that extends therethrough to movably secure the plunger, at least partially within the cylindrical bore of the cylindrical housing, and at the first end portion thereof; and proving a spring and installing the spring in the cylindrical bore adjacent the plunger so as to positionally bias the plunger away from the second end portion of cylindrical housing, so as to align and positionally maintain the first end portion of the cylinder within the bolt carrier group compartment;

providing an elongate lever that has a first end portion, a second end portion, a top surface and a bottom surface and pivotally interconnecting the elongate lever to the cylindrical housing within the partial circumferential cut-out portion so that elongate lever is pivotally movable between a resting position and an activated position relative to the cylindrical housing by pivoting upon a fulcrum pin that extends transversely through aligned holes defined in the first end portion of the elongate lever and defined in the cylindrical housing, and an inclined ramp is carried on the top surface of the elongate lever between the first end portion and the second end portion, and a raised cylindrical projection is carried on the top surface of the elongate lever proximate the second end portion to operatively engage with a spring that biases the second end portion of the elongate lever outwardly from the partial circumferential cutout portion and toward the resting position, and a rectangular projection is carried on the top surface of the elongate lever between the raised cylindrical projection and a proximate end portion of the inclined ramp, the rectangular projection defining a transversely aligned slotted hole therein;

providing a detent reed that is formed of a resilient metal, and positionally securing the detent reed on the inclined ramp of the elongate lever, and the detent reed emits an audible and tactile simulation that replicates a release and reset of the semi-automatic rifle firing pin when the elongate lever pivots on the transverse fulcrum pin between the resting position and the activated position responsive to activation of the trigger of the semi-automatic rifle, and return of the trigger to an unfired position;

providing a transfer block and interconnecting the transfer block with the elongate lever at a predetermined position on a bottom surface thereof so that the transfer block operatively communicates with the trigger of the semi-automatic rifle so as to transfer movement of the semi-automatic rifle's trigger to the elongate lever and to cause the elongate lever to pivot upon the fulcrum pin, relative to the generally cylindrical housing, between the resting position and the activated position; and providing a hammer keeper and positioning the hammer keeper within the bolt carrier group compartment immediately adjacent a hammer of the semi-automatic rifle so that the trigger of the semi-automatic is movable without activating the hammer of the semi-automatic rifle; and installing the cylinder and its components into the bolt carrier group compartment defined in the functional semi-automatic rifle in place of the functional bolt carrier group, and engaging the transfer block carried by the cylinder with the trigger of the fully functional semi-automatic rifle; and presenting, aiming and firing the semi-automatic rifle by repeatedly activating and releasing the trigger of the semi-automatic rifle which responsively moves the elongate lever and the detent reed between the resting position and the activated position so as to replicate the tactile and audible feel and sound of the semi-automatic rifle's firing pin release for dry fire training each time the semi-automatic rifle's trigger is activated so as to become accustomed to the trigger feel without a recoil or a report of live firing while remaining in the firing position so as to build precise muscle memory with only trigger finger motion.

2. The method for dry fire training with a semi-automatic rifle of claim 1 and further comprising the step:

providing a set screw that is carried in a threaded hole defined in the upper section of the generally cylindrical housing, and the set screw provides a means of regulating when the detent reed activates to simulate a release and reset of the semi-automatic rifle's firing pin.

3. The method for dry fire training with a semi-automatic rifle of claim 1, and further comprising the step;

providing a coil spring and positioning the coil spring on the raised cylindrical projection on the top surface of the elongate lever so that the coil spring operatively communicates with the generally cylindrical housing to provide a downward force to return the elongate lever to the resting position; and providing a second coil spring to bias the axially movable plunger toward the first end portion of the cylinder to positionally align the dry fire training device in the semi-automatic rifle's bolt carrier group compartment.

4. The method for dry fire training with a semi-automatic rifle of claim 1, and wherein the transfer block frictionally communicates with the trigger of the semi-automatic rifle, and the transfer block moves up and down responsive to movement of the trigger of the semi-automatic rifle; and the transfer block communicates the up and down movement to the bottom surface of the elongate lever.

5. A method of assembling a dry fire training device for a semi-automatic rifle that defines a bolt carrier group compartment which carries a bolt carrier group therein, and wherein the bolt carrier group moves reciprocally within the bolt carrier group compartment between a first position, and a second position, in response to live ammunition being fired from the semi-automatic rifle or in response to a user manually moving the bolt carrier group between the first position and the second position, the method comprising the steps:

providing a cylinder that is shaped and configured to operatively cooperate within the bolt carrier group compartment, the provided cylinder forming a generally cylindrical housing, that is elongate and which has a first end portion, a second end portion, an upper section, a lower section and a mid-section and, defining a generally cylindrical bore in the generally cylindrical housing that extends between the first end portion and the second end portion, and defining a partial circumferential cut-out in the lower section of the generally cylindrical housing and the partial circumferential cut-out begins at the second end portion and extends toward the first end portion but does not communicate with the first end portion, and forming a protuberance on the upper section of the generally cylindrical housing proximate the second end portion and opposite the circumferential cut-out for alignment of the second end portion of the generally cylindrical housing in the bolt carrier group compartment;

providing a coil spring and positioning the coil spring within the generally cylindrical bore of the generally cylindrical housing and proximate the first end portion thereof;

providing a plunger and defining a diametrically extending through slot in the plunger, and positioning the plunger within the generally cylindrical bore and at the first end portion thereof so that the plunger is at least partially axially movable within the generally cylindrical bore, the plunger having a protuberance that extends axially outwardly from the plunger opposite the generally cylindrical bore;

providing a fulcrum pin and positioning the fulcrum pin through a pair of aligned holes defined in the generally cylindrical housing proximate the first end portion thereof so that the fulcrum pin simultaneously extends through the diametrically extending through slot defined in the plunger to movably secure the plunger at least partially within the cylindrical bore of the cylindrical housing, and at the first end portion thereof, and the plunger is biased away from the second end portion of cylindrical housing by the coil spring, and the coil spring biasing of the plunger provides for positionally maintaining the first end portion of the cylinder within the bolt carrier group compartment;

providing an elongate lever that has a first end portion, a second end portion, a top surface and a bottom surface and pivotally interconnecting the elongate lever within the partial circumferential cut-out portion of the cylindrical housing so that the elongate lever is movable between a resting position and an activated position relative to the cylindrical housing by pivoting upon a fulcrum pin that extends transversely though aligned holes defined in the first end portion of the elongate lever and defined in the cylindrical housing within the circumferential cut-out, and the elongate lever has an inclined ramp that is carried on the top surface thereof between the first end portion and the second end portion, and the elongate lever further has a raised cylindrical projection is carried on the top surface proximate the second end portion to engage with and carry a coil spring thereon that frictionally communicates with the generally cylindrical housing so as to bias the second end portion of the elongate lever toward the resting position, and the elongate lever still further has a rectangular projection that is carried on the top surface thereof between the raised cylindrical projection and a proximate end portion of the inclined ramp, the rectangular projection defines a transversely aligned slotted hole therein; and providing a detent reed that is formed of a resilient metal, and positionally securing the detent reed on the inclined ramp of the elongate lever, and the detent reed emits an audible and tactile simulation that replicates a release and reset of the firing pin of the semi-automatic rifle when the elongate lever pivots on the transverse fulcrum pin between the resting position and the activated position responsive to activation of the trigger of the semi-automatic rifle and return of the trigger to an unfired position; and providing a transfer block and interconnecting the transfer block with the elongate lever at a predetermined position on a bottom surface thereof, so that the transfer block operatively communicates with the trigger of the semi-automatic rifle so as to transfer movement of the trigger of the semi-automatic rifle to the elongate lever and to cause the elongate lever to pivot between the resting position and the activated position; and providing a hammer keeper that operatively communicates with the hammer of the semi-automatic rifle so that the trigger of the semi-automatic is movable without activating the hammer of the semi-automatic rifle.

6. The method for assembling a dry fire training device for a semi-automatic rifle of claim 5 and further comprising the step:

defining more than one pair of transversely extending and axially aligned through holes in the generally cylindrical housing for carriage of a pin to interconnect movable components to the generally cylindrical housing.

7. The method for assembling a dry fire training device for a semi-automatic rifle of claim 5 and further comprising the step:

defining a threaded hole in the upper section of the generally cylindrical housing and providing a set screw that is carried in the threaded hole defined in the upper section of the generally cylindrical housing, and the set screw provides a means of regulating when the detent reed activates to simulate a release and reset of the semi-automatic rifle's firing pin.

8. The method for assembling a dry fire training device for a semi-automatic rifle of claim 5 and wherein the transfer block frictionally communicates with the trigger of the semi-automatic rifle, and the transfer block moves up and down responsive to movement of the trigger of the semi-automatic rifle; and the transfer block communicates the up and down movement to the bottom surface of the elongate lever.

9. A method for modifying a fully functional semi-automatic rifle for use in dry-fire training comprising the steps:

providing a functional semi-automatic rifle that defines a bolt carrier group compartment and which removably carries a functional bolt carrier group therein, and wherein the functional bolt carrier group carried in the bolt carrier group compartment, moves reciprocally between a first position, and a second position, in response to live ammunition being fired from the functional semi-automatic rifle, or in response to a user manually moving the functional bolt carrier group between the first position and the second position which in both cases responsively resets a firing pin and a hammer of the fully functional semi-automatic rifle; and removing the functional bolt carrier group from the bolt carrier group compartment of the fully functional semi-automatic rifle;

providing a cylinder that forms a generally cylindrical housing, that is elongate and which has a first end portion, a second end portion, an upper section, a lower section and a mid-section and which defines a generally cylindrical bore between the first end portion and the second end portion, and the lower section of the cylindrical housing defines a partial circumferential cut-out that begins at the second end portion and extends toward the first end portion but does not communicate with the first end portion, and the upper section carries a protuberance proximate the second end portion and opposite the partial circumferential cut-out for alignment of the cylindrical housing in the bolt carrier group compartment;

providing a plunger, and installing the plunger in the cylindrical bore defined in the cylindrical housing so that the plunger is axially movably carried in the cylindrical bore at the first end portion thereof, the plunger having a protuberance that extends axially outwardly from the plunger, and opposite the cylindrical bore, and the plunger further defines a diametrically extending through slot for a fulcrum pin that extends therethrough to movably secure the plunger, at least partially within the cylindrical bore of the cylindrical housing, and at the first end portion thereof; and providing a spring and installing the spring in the cylindrical bore adjacent the plunger so as to positionally bias the plunger away from the second end portion of cylindrical housing and to align and positionally maintain the cylinder within the bolt carrier group compartment;

providing an elongate lever that has a first end portion, a second end portion, a top surface and a bottom surface and interconnecting the elongate lever to the cylinder within the partial circumferential cut-out portion of the cylindrical housing with a transversely extending fulcrum pin so that the elongate lever is pivotally movable between a resting position and an activated position relative to the cylindrical housing by pivoting upon the transverse fulcrum pin which extends through aligned holes defined in the first end portion of the elongate lever and defined in the cylindrical housing, and an inclined ramp is carried on the top surface of the elongate lever between the first end portion and the second end portion, and a raised cylindrical projection is carried on the top surface of the elongate lever proximate the second end portion to engage with a spring that biases the elongate lever toward the resting position, and a rectangular projection is carried on the top surface of the elongate lever between the raised cylindrical projection and a proximate end portion of the inclined ramp, the rectangular projection defining a transversely aligned slotted hole therein;

providing a detent reed, and positionally securing the detent reed on the inclined ramp of the elongate lever, and the detent reed is formed of a resilient metal which emits an audible and tactile simulation that replicates a release and reset of the semi-automatic rifle firing pin when the elongate lever is moved between the resting position and the activated position responsive to activation of the trigger of the semi-automatic rifle, and return of the trigger to an unfired position;

providing a transfer block that operatively communicates between the trigger of the semi-automatic rifle and the bottom surface of the elongate lever proximate the second end portion of the elongate lever, for transferring movement of the semi-automatic rifle's trigger to the elongate lever and to cause the elongate lever to pivot, relative to the generally cylindrical housing, between the resting position and the activated position; and providing a hammer keeper and positioning the hammer keeper within the bolt carrier group compartment immediately adjacent a hammer of the semi-automatic rifle so that the trigger of the semi-automatic is movable without activating the hammer of the semi-automatic rifle; and installing the cylinder and its components into the bolt carrier group compartment defined in the functional semi-automatic rifle in place of the functional bolt carrier group, and engaging the transfer block carried by the cylinder with the trigger of the fully functional semi-automatic rifle; and presenting, aiming and firing the semi-automatic rifle by repeatedly activating and releasing the trigger of the semi-automatic rifle which responsively moves the elongate lever and the detent reed between the resting position and the activated position so as to replicate the tactile and audible feel and sound of the semi-automatic rifle's firing pin release for dry fire training each time the semi-automatic rifle's trigger is activated so as to become accustomed to the trigger feel without a recoil or a report of live firing while remaining in the firing position so as to build precise muscle memory with only trigger finger motion.

* * * * *